US006129637A

United States Patent [19]

Wang et al.

[11] Patent Number: 6,129,637

[45] Date of Patent: Oct. 10, 2000

[54] GOLF PRACTICE DEVICE

[76] Inventors: Chih-Chiang Wang, No. 97-19, Sec.1, Chung Yang Road; Chih-Neng Wang, No.30, Tzyh Chyang 2 Street, both of Wu Chi Chen,Taichung Hsien, Taiwan

[21] Appl. No.: 09/298,916

[22] Filed: Apr. 26, 1999

[51] Int. Cl.[7] ..... A63B 69/36

[52] U.S. Cl. ..... 473/145; 473/429

[58] Field of Search ..... 473/139, 140, 473/145, 146, 147, 278, 279, 280, 423, 429, 430

[56] References Cited

U.S. PATENT DOCUMENTS

| | | | |
|---|---|---|---|
| 5,255,920 | 10/1993 | Mangeri | 473/145 X |
| 5,480,141 | 1/1996 | Wood | 473/145 X |
| 5,577,964 | 11/1996 | Chen | 473/145 |
| 5,803,836 | 9/1998 | Beintema | 473/429 |
| 5,833,555 | 11/1998 | Jer-Min | 473/429 |

*Primary Examiner*—Kien T. Nguyen
*Attorney, Agent, or Firm*—Dougherty & Troxell

[57] ABSTRACT

A golf practice device comprised of a base having on the top surface a section of artificial turf and a positioning support. A rod is pivot mounted to the front end of the positioning support and the leading end of the rod is pivot mounted to a ball to form the directional control mount. The rod of the directional control mount is inserted such that the ball enters a threaded section, at the bottom end of which is the connection rod of a swivel mount having an internal spherical-shaped space, and until the threaded section is situated laterally against the ball of the direction control mount. This enables assembly to the swivel mount so that the ball of the direction control mount is contained in the swivel fitting of the swivel assembly. The swivel mount and the connection rod at the top and bottom ends of the swivel assembly are structurally coordinated with a golf ball at the bottom end of another rod forming the golf ball assembly. Following the assembly of the said structure, while the user is engaged in golf club swinging practice, in addition to providing for swinging practice, the invention herein offers increased practical performance by indicating to the user whether the golf club has hit the golf ball squarely or not and, furthermore, allows for the appropriate corrections.

2 Claims, 5 Drawing Sheets

GOLF PRACTICE DEVICE

BACKGROUND OF THE INVENTION

1) Field of the Invention

The invention herein relates to a golf practice device that improves upon the disadvantages of conventional golf practice devices that only provide for simple golf club swinging practice and are incapable of effective correction adjustments. With the structure of the invention herein, while the user is engaged in golf club swinging practice, in addition to providing for swinging practice, the invention herein offers increased practical performance by indicating to the user whether the golf club has hit the golf ball squarely or not and, furthermore, allows for the appropriate corrections, which is among the major innovations of the present invention.

2) Description of the Prior Art

More and more people are playing the sport of golf. The greatest pleasure of golf is using the golf club to swing at and accurately hitting a ball that is only about four centimeters in diameter and have it land at the location targetted. However, even if the golfer swing is only slightly off the mark, that slight divergence usually results in great inaccuracy. As such, golfers must practice their swing before actually playing on the golf course so they can achieve the desired proficiency.

Therefore, golf ball swinging practice structures are available on the market just for such purposes and as indicated in FIG. 1 and FIG. 2, one such product is comprised of a rotary assembly 3 mounted on a support 2, with a golf ball assembly 3 pivot mounted to the rotary assembly 3; furthermore, the said rotary assembly 3 consists of an upper and lower shell 31 and 32, each having a semicircular recess along the inner walls and two ribs 311 and 321, respectively, and positioned in between the two pairs of ribs is a bearing 33, and the bearing 33 is mounted on the relatively small diameter tip 21 of the support 2 and secured in place by a lock pin 331; the inner sides of the upper and lower shell 31 and 32 form a containment cavity 34, and there is an insertion slot 322 in the containment cavity 34 of the lower shell 32; the golf ball assembly 4 consists of a pliable plastic rod 41, a retainer 42, and a golf ball 43, of which a sphere 411 is formed on the upper end of the pliable plastic rod 41 which enables a restraining insertion into the containment cavity 34 of the rotary assembly; following the assembly of the said structure, when utilized to practice the golf swing, the golf club (not shown in the drawings) is aligned with the golf ball 43 at the bottom end of the golf ball assembly 4 and after the golf ball 43 is hit, the impacted golf ball 43 causes the sphere 411 at the top end of the pliant plastic rod 41 to become restrained in the containment cavity 34 of the rotary assembly 3 which then causes the rotary assembly 3 to spin around the support 2 via the bearing 33 mounted on the relatively small diameter tip 21 of the support 2 until the golf ball 43 at the bottom end of the golf ball assembly 4 returns to its original hanging position, at which time another swing can be practiced.

Each time the user hits the golf ball 43 at the bottom end of the golf ball assembly 4, the sphere 411 at the top end the pliant plastic rod 41 becomes restrained in the containment cavity 43 of the rotary assembly 3 and the rotary assembly 3 spins around the relatively small diameter tip 21 of the support in the same direction before coming to rest in its original hanging position so the user can practice swinging again; in other words, the conventional structure only provides an extremely basic mode of practice to the user, wherein each time the golf ball 43 at the bottom end of the golf ball assembly 4 is struck, the entire rotary assembly simply rotates around the relatively small diameter tip 21 of the support 21, and if the golf club failed to hit golf ball 43 at the bottom end of the golf ball assembly 4, the golf ball 43 would remain unmoved and after the swing and knowing whether the golf club hit the center of gravity of the golf ball 43 at the bottom end of the golf ball assembly 4 would not be possible, which illustrates that this kind of golf practice device is only capable of providing the user a single-faceted and simple means of golf ball 43 hitting practice, without effectively allowing the user to know whether the golf ball 43 was hit squarely at its center of gravity. As a result, when the user of such a product actually plays on the golf course, it is easier to hit the relatively small golf ball, but the directional accuracy to targetted location may still be wanting because the conventional structure still requires improvement.

Therefore, the inventor of the invention herein, fully cognizant of the existent shortcomings of conventional golf practice structures and relying on many years of experience in the field of sports equipment manufacturing and assembly, conducted research to develop an improved structure which culminated in the golf practice device of the invention herein, an innovative device that improves upon the shortcomings of the conventional structures and, therefore, is submitted in application for the granting of the commensurate patent rights.

SUMMARY OF THE INVENTION

The primary objective of the invention herein is to provide a golf practice device comprised of a base having on the top surface a section of artificial turf and a positioning support, wherein the rod is pivot mounted to the front end of the positioning support and the leading end of the rod is pivot mounted to a ball to form the directional control mount; the rod of the directional control mount is inserted such that the ball of the directional control mount enters the threaded section, at the bottom end of which is the connection rod of the swivel mount which has an internal spherical-shaped space, until the threaded section is situated laterally against the ball of the direction control mount, which enables assembly to the swivel mount such that the ball of the direction control mount is contained in the swivel fitting of the swivel assembly; the swivel mount and the connection rod at the top and bottom ends of the swivel assembly are structurally coordinated with the golf ball at the bottom end of the rod forming the golf ball assembly; following the assembly of the said structure, while the user is engaged in golf club swinging practice, in addition to providing for swinging practice, the invention herein offers increased practical performance by indicating to the user whether the golf club has hit the golf ball squarely or not and, furthermore, allows for the appropriate corrections, which is among the major innovations of the present invention.

To enable a further understanding of the structure, innovations, operation, and other objectives of the invention herein, the brief description of the drawing below are following by the detailed description of the present invention.

DETAILED DESCRIPTION OF THE INVENTION

Figure 1:
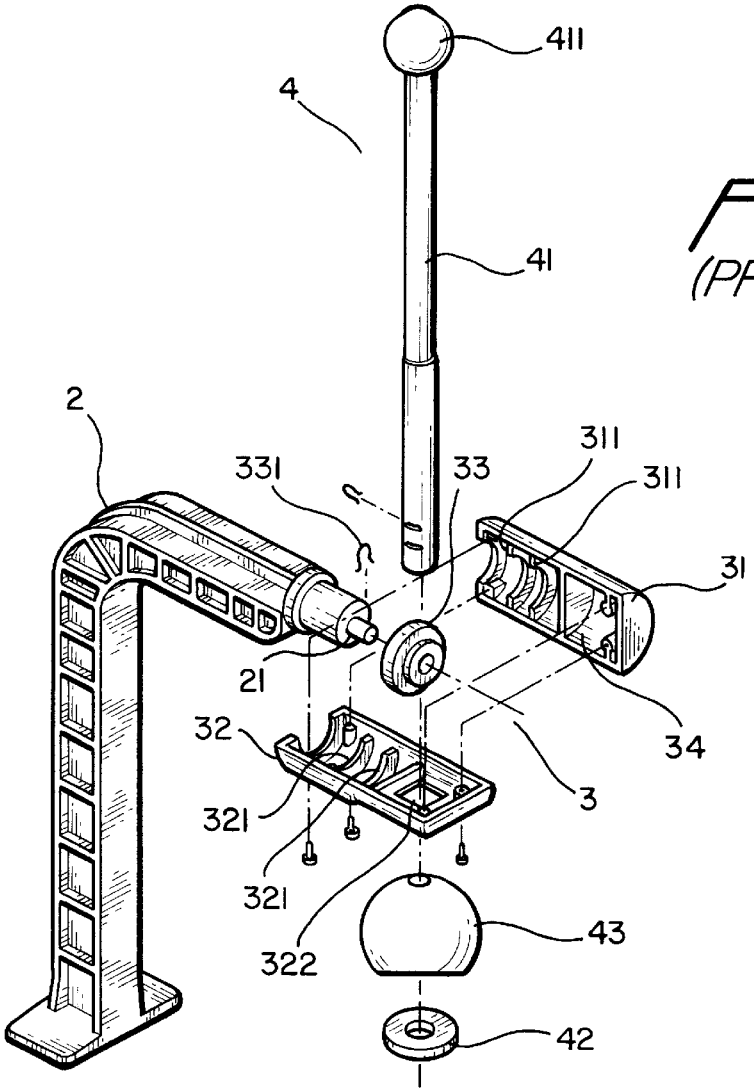
FIG. 1 (PRIOR ART)
FIG. 1 is an isometric exploded drawing of a conventional structure.
Figure 2:
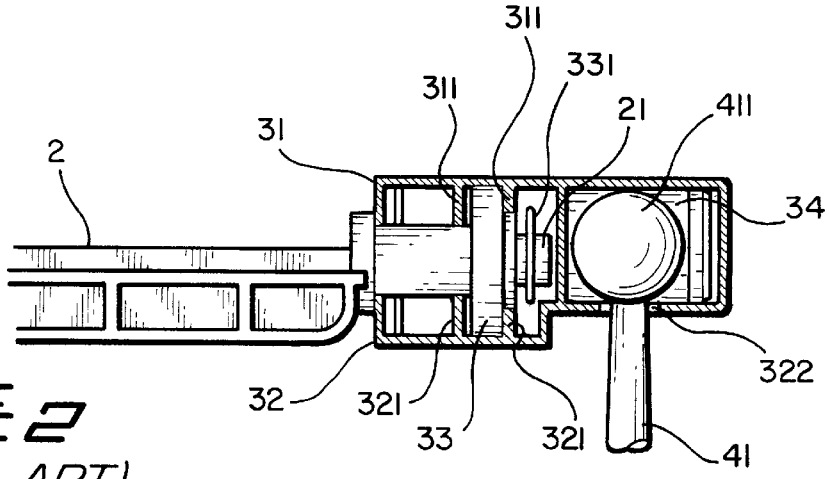
FIG. 2 (PRIOR ART)
FIG. 2 is a cross-sectional drawing of a conventional structure.
Figure 3:
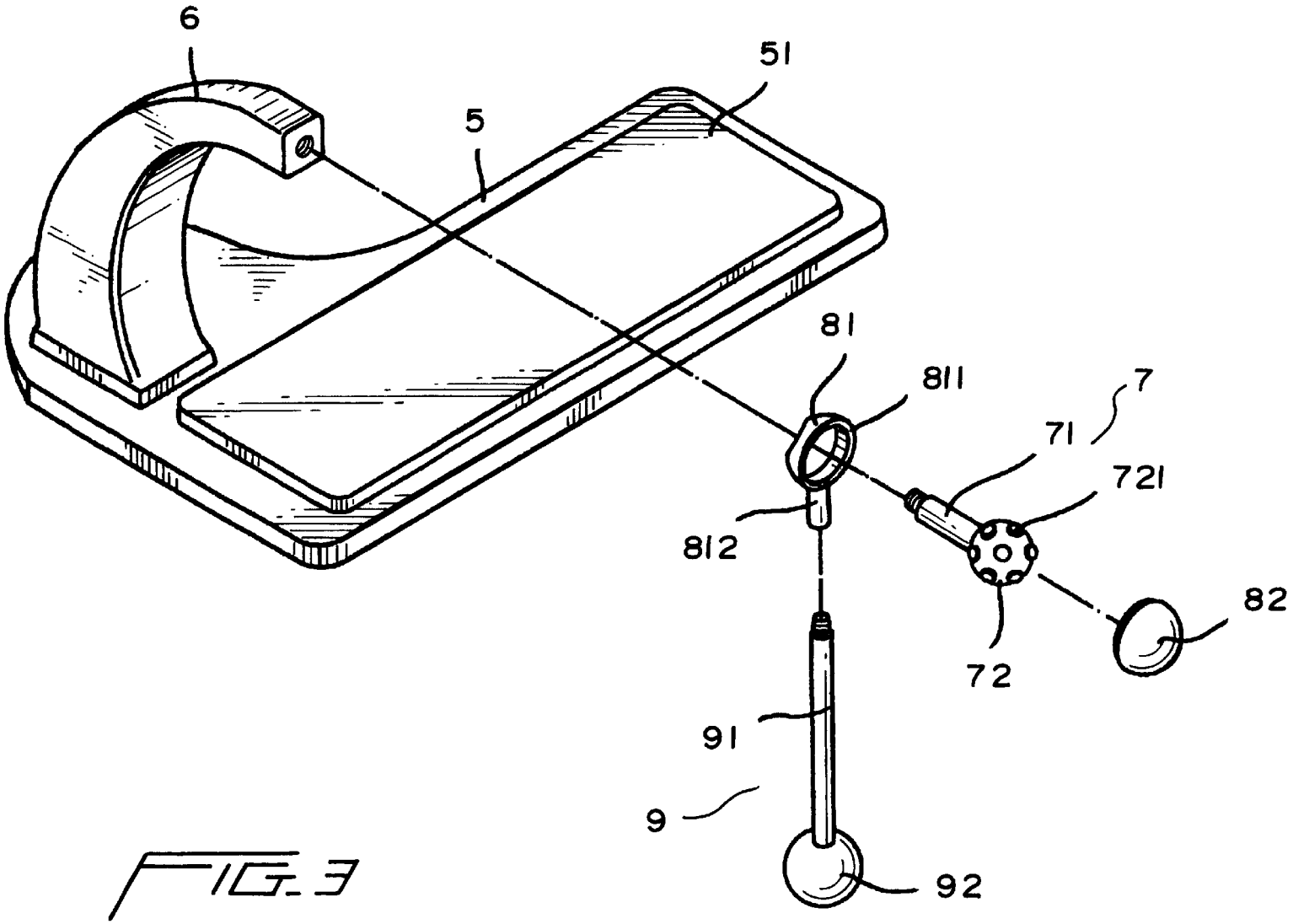
FIG. 3 is an isometric exploded drawing of the invention herein.
Figure 4:
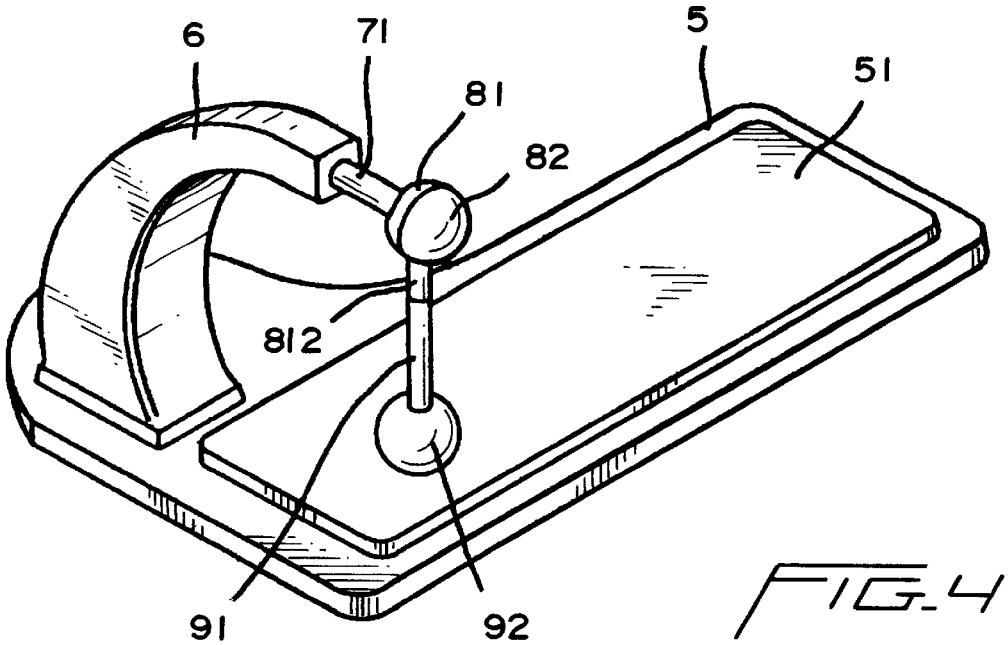
FIG. 4 is an isometric drawing of the structural assembly of the invention herein.
Figure 5:
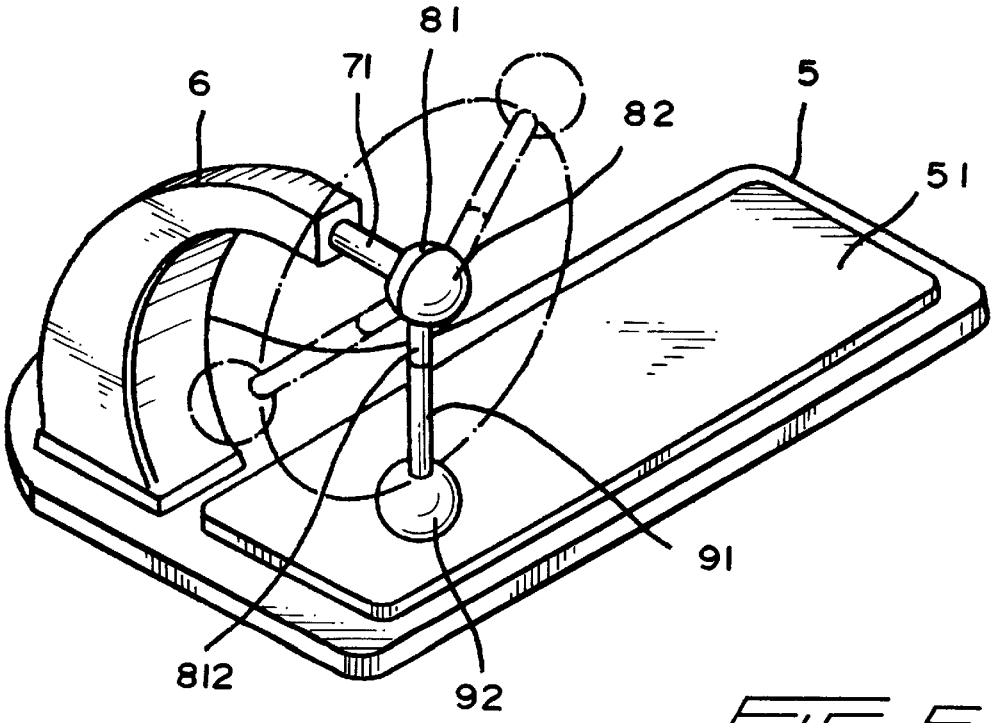
FIG. 5 is an isometric drawing of the invention herein illustrating the operation of the structural assembly.
Figure 6:
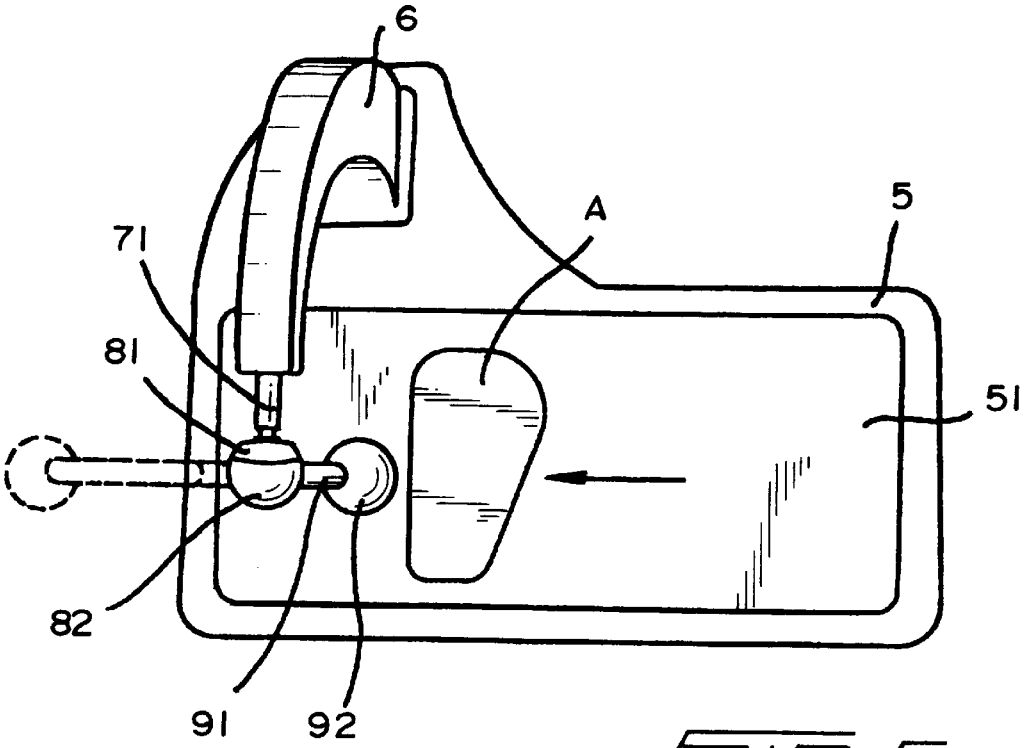
FIG. 6 is an isometric drawing of the invention illustrating the operation of the structure (when the shaft is swung at the exact center of gravity of the ball, as viewed from a top perspective).

Referring to FIG. 3, FIG. 4, and FIG. 5, the structure of the invention herein is comprised of a base 5 having on the top surface a section of artificial turf 51 and a positioning support 6, and the major innovations of the invention herein are: a rod 71 is pivot mounted to the front end of the positioning support 6 and the leading end of the rod 71 is pivot mounted to a ball 72 to form a directional control mount 7; the rod 71 of the directional control mount 7 is inserted such that the ball 72 of the directional control mount 7 enters the threaded section 811, at the bottom end of which is the connection rod 812 of the swivel mount 81 which has an internal spherical-shaped space 821, until the threaded section is 811 situated laterally against the ball 72 of the direction control mount 7, which enables assembly to the swivel mount 81 such that the ball 72 of the direction control mount 7 is contained in the swivel fitting 82 of the swivel assembly 8; as can be observed, different fabrication lengths are required, such that the swivel mount 81 and the connection rod 812 at the top and bottom ends of the swivel assembly 8 are structurally coordinated with the golf ball 92 at the bottom end of the rod 91 forming the golf ball assembly 9.

Figure 7:
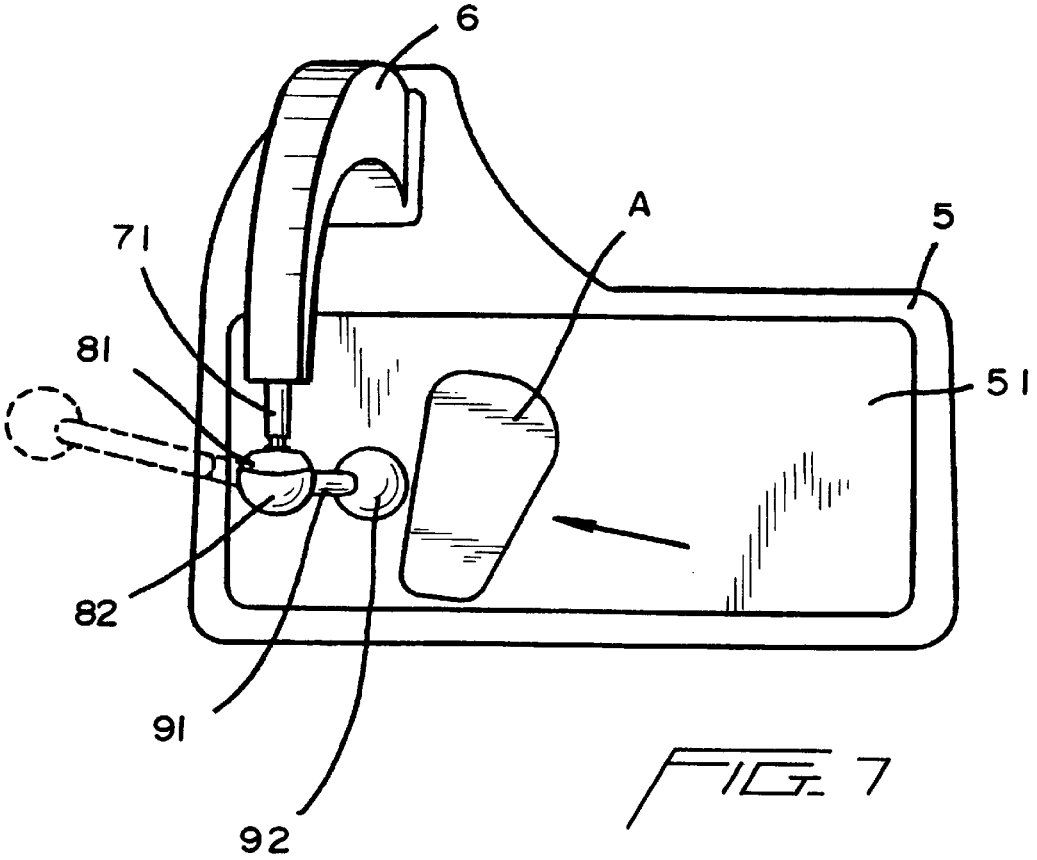
FIG. 7 is an isometric drawing of the invention illustrating the operation of the structure (when the shaft is not swung at the exact center of gravity of the ball, as viewed from a top perspective).
Figure 9:
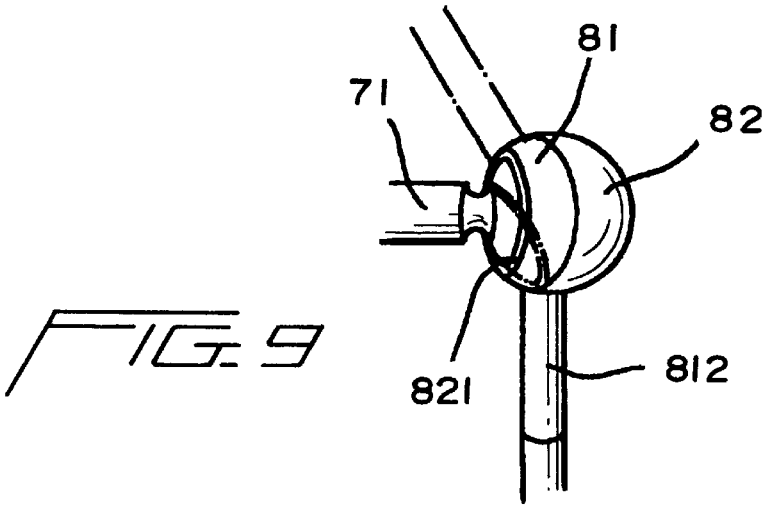
FIG. 9 is a partial isometric drawing of the invention herein illustrating the operation of the structure (when the shaft is not swung at the exact center of gravity of the ball, as viewed from a lateral perspective).
Figure 8:
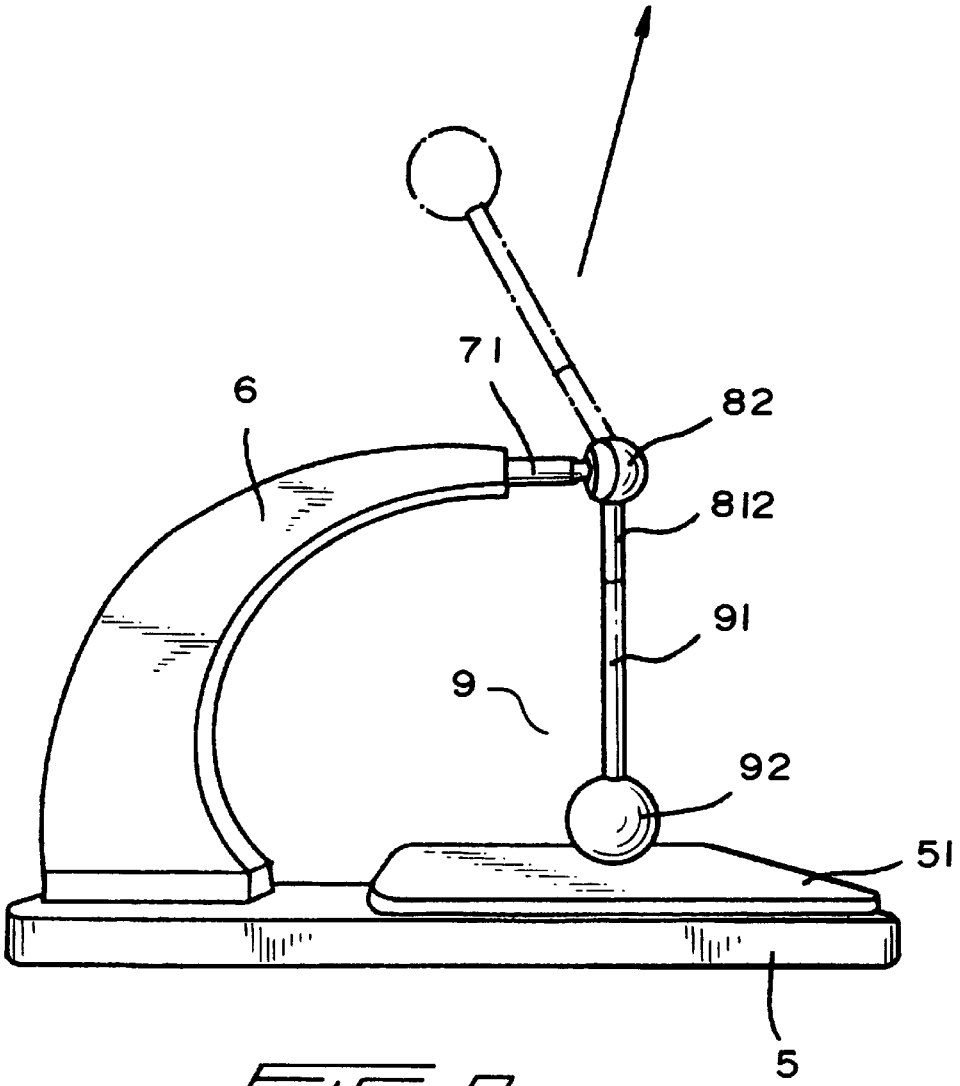
FIG. 8 is an isometric drawing of the invention illustrating the operation of the structure (when the shaft is not swung at the center of gravity of the ball, as viewed from a lateral perspective).

Following the assembly of the said structure, referring to FIG. 4, FIG. 5, FIG. 6, FIG. 7, FIG. 8, and FIG. 9, when the user practices swinging a golf club at the golf ball, the golf club is directed towards the golf ball 92 at the bottom end of the golf ball assembly 9, and after the golf ball 92 is hit by the head A of the golf club, since the rod 71 of the direction control mount 7 is ensconced in the swivel assembly 8, there is the threaded section 811 along the inner side where the ball 72 of the direction control mount 7 resides, the connecting rod 812 of the swivel mount 81 is at the bottom end, and there is the internal spherical-shaped space 821, until the threaded section 811 is situated laterally against the ball 72 of the direction control mount 7, permitting assembly to the swivel mount 81 such that the ball 72 of the direction control mount 7 is contained in the swivel fitting 82 of the swivel assembly 8, and this enables the pivotable attachment of the golf ball assembly 9 to the connecting rod 812 at the bottom end of the swivel mount 81, such as the golf ball 92 at the bottom end of the golf ball assembly 9 is struck by the golf club head A during practice, after the said golf ball assembly 9 is attached to the assembled swivel mount 81 and the swivel fitting 82 of the swivel assembly 8, the ball 72 surface at the most forward end of the direction control mount 7 rod 72 is entirely contained within the internal spherical-shaped space 821 to achieve a ball and socket coupling contact, the position and direction of the golf ball 92 hit by the golf club head A is very much directly determined by the resulting rebound of the golf ball 92 at the bottom end of the golf ball assembly 9, which causes the swivel assembly 8 to rotate in the relative direction around the pivot mounted ball 72 in the ball and socket coupling contact at the front end of the direction control mount 7 rod 71 and thereby providing knowledge of the exact direction of the struck golf ball 92, and when the rotational orientation deviates (as indicated in FIG. 7, FIG. 8, and FIG. 9), the swinging posture and angle can be corrected accordingly during the practicing process, which not only enhances the mechanical efficiency of the struck golf ball as is the case with most conventional structures, but also allow for the correction of the swing to hit the exact center of gravity of the golf ball while practicing to effectively achieve angular and directional accuracy.

Furthermore, referring to FIG. 3, there are a number of protrusions 721 arrayed on the entire pivot mounted spherical surface of the ball 72 at the front end of the direction control mount 7 rod 71 such that when said ball 72 is contained in the swivel mount 81 and the swivel fitting 82 of the swivel assembly 8 and, furthermore, subjected to the swinging action of the golf club, the surface contact is increased between the swivel assembly 8 internal section and the ball 72 to thereby provide a precise indication of the angle and the direction of the swing.

In summation of the foregoing section, since the structure of the invention herein is simpler yet more enhanced than the conventional structure because while the user is engaged in golf club swinging practice, in addition to providing for swinging practice, the invention herein offers increased practical performance by indicating to the user whether the golf club has hit the golf ball squarely or not and, furthermore, allows for the appropriate corrections, the invention herein complies with new patent application requirements and is hereby submitted to the Patent Bureau for review and the granting of the commensurate patent rights.

We claim:

1. A golf practice device comprising: a base having on a top surface a section of artificial turf and a positioning support; a rod pivotally mounted to a front end of the positioning support, a distal end of the rod is pivotally mounted to a ball which is located in a threaded section of a swivel mount, from a bottom end of which extends a connection rod; a swivel fitting having an internal spherical-shaped space, attached to the swivel mount to form a swivel assembly such that the ball is contained in the internal space; and a golf ball mounted on a bottom end of the connection rod thereby forming a golf ball practice device indicating to the user whether the golf ball has been hit squarely.

2. The golf practice device as claimed in claim 1 further comprising a plurality of protrusions arrayed on a surface of the ball such that when said ball is contained in the swivel mount and the swivel fitting of the swivel assembly and subjected to swinging action of a golf club, surface contact is increased between the swivel assembly and the ball to thereby provide a precise indication of the angle and the direction of the swing.

* * * * *